US006516535B1

(12) United States Patent
Chen

(10) Patent No.: US 6,516,535 B1
(45) Date of Patent: Feb. 11, 2003

(54) DUAL PURPOSE HAIR DRYER

(76) Inventor: Shou Mao Chen, 344, Section 1 Chung Shan Rd., Tah-Cha Township Taichung Hsien (TW)

( * ) Notice: Subject to any disclaimer, the term of this patent is extended or adjusted under 35 U.S.C. 154(b) by 0 days.

(21) Appl. No.: 10/039,563

(22) Filed: Jan. 8, 2002

(51) Int. Cl.[7] ..... F26B 19/00

(52) U.S. Cl. ..... 34/90; 34/91; 34/96; 219/245; 219/249

(58) Field of Search ..... 34/90, 91, 96; 219/245, 249, 250; D32/9, 68; 392/380–385; 132/271; 38/74, 75

(56) References Cited

U.S. PATENT DOCUMENTS 4,524,263 A * 6/1985 Yamac ..... 219/249
4,634,836 A * 1/1987 Yamac ..... 219/249
4,636,613 A * 1/1987 de la Morandiere et al. .... 219/249
4,685,229 A * 8/1987 Moravek et al. ..... 38/84
4,721,121 A * 1/1988 Adams ..... 132/212
4,810,855 A * 3/1989 Dassi et al. ..... 219/474
4,857,706 A * 8/1989 Diamond ..... 392/383
D311,617 S * 10/1990 Diamond ..... D32/68
5,170,038 A * 12/1992 Aida ..... 219/249
D365,418 S * 12/1995 Wai ..... D28/15

* cited by examiner

*Primary Examiner*—Ira S. Lazarus
*Assistant Examiner*—Andrea M. Ragonese
(74) *Attorney, Agent, or Firm*—Harrison & Egbert

(57) ABSTRACT

A dual purpose implement can be used as a hair dryer or flatiron. The implement includes a barrel, a barrel grille, a hot plate, a hot air obstruction plate, and a barrel cap. Without the use of the barrel cap, the implement serves as the hair dryer. With the use of the barrel cap in place of the barrel grille, and with the removal of the hot air obstruction plate, the implement serves as the flatiron.

1 Claim, 6 Drawing Sheets

DUAL PURPOSE HAIR DRYER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a hair grooming implement, and more particularly to a hair dryer which can be also used as an iron for pressing clothes.

BACKGROUND OF THE INVENTION

Personal items are generally designed for a single purpose. The case in point is a hair dryer or flatiron. In view of the fact that both hair dryer and flatiron comprise a heating element, it is technically feasible to combine these two personal items as a dual-purpose implement, which would be a welcome adjunct for a frequent business traveler.

BRIEF SUMMARY OF THE INVENTION

The primary objective of the present invention is to provide a novel hair dryer which comprises a barrel and a barrel cap. The barrel is provided in the top surface with a hot plate and a hot air obstruction plate. The hot prate is provided with a plurality of air holes. Without the barrel cap, the hair dryer is used to groom the hair. Without the hot air obstruction plate, the hair dryer is used for pressing clothes.

The features and the advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
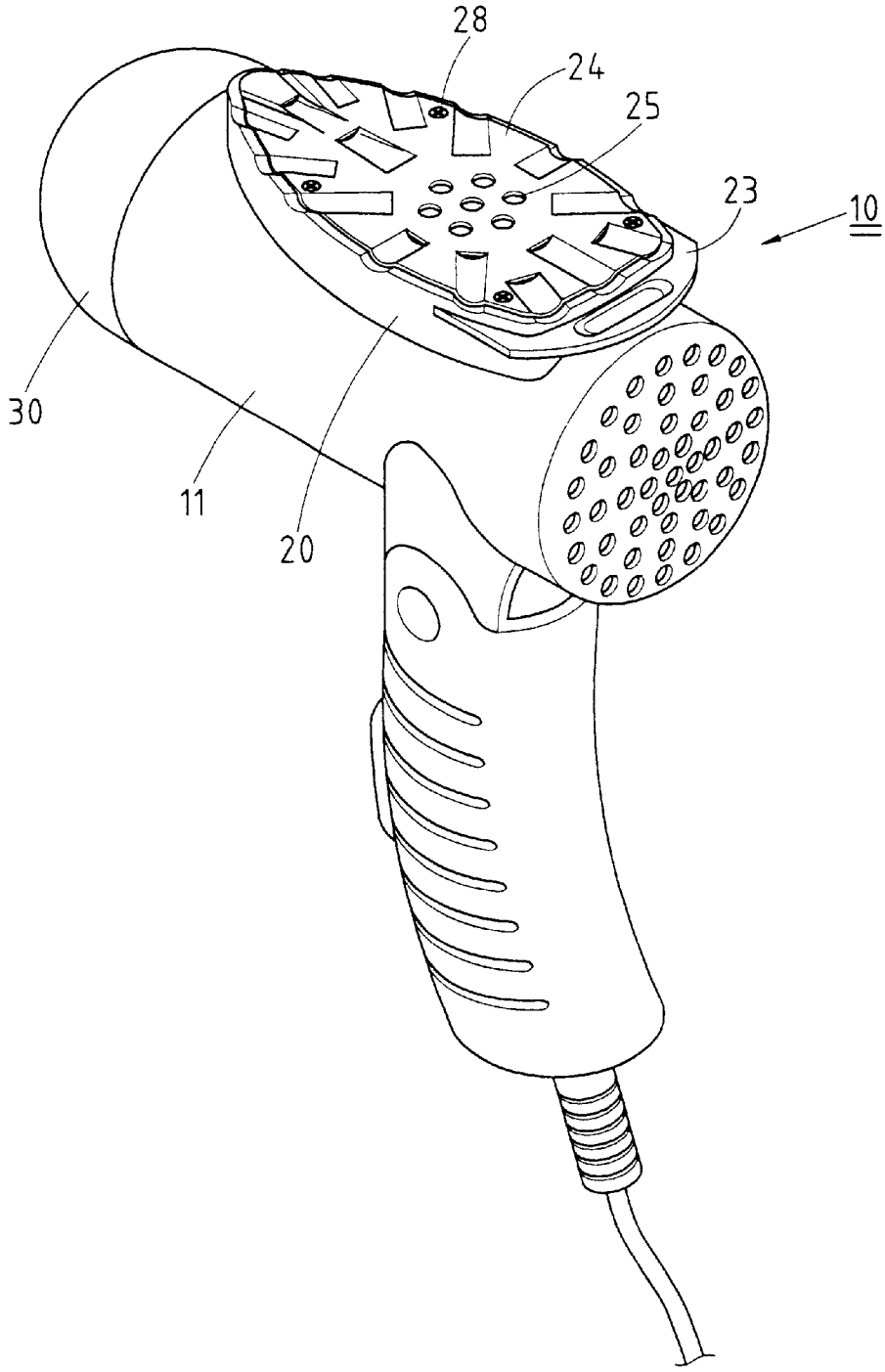
FIG. 1 shows a perspective view of the preferred embodiment of the present invention.
Figure 2:
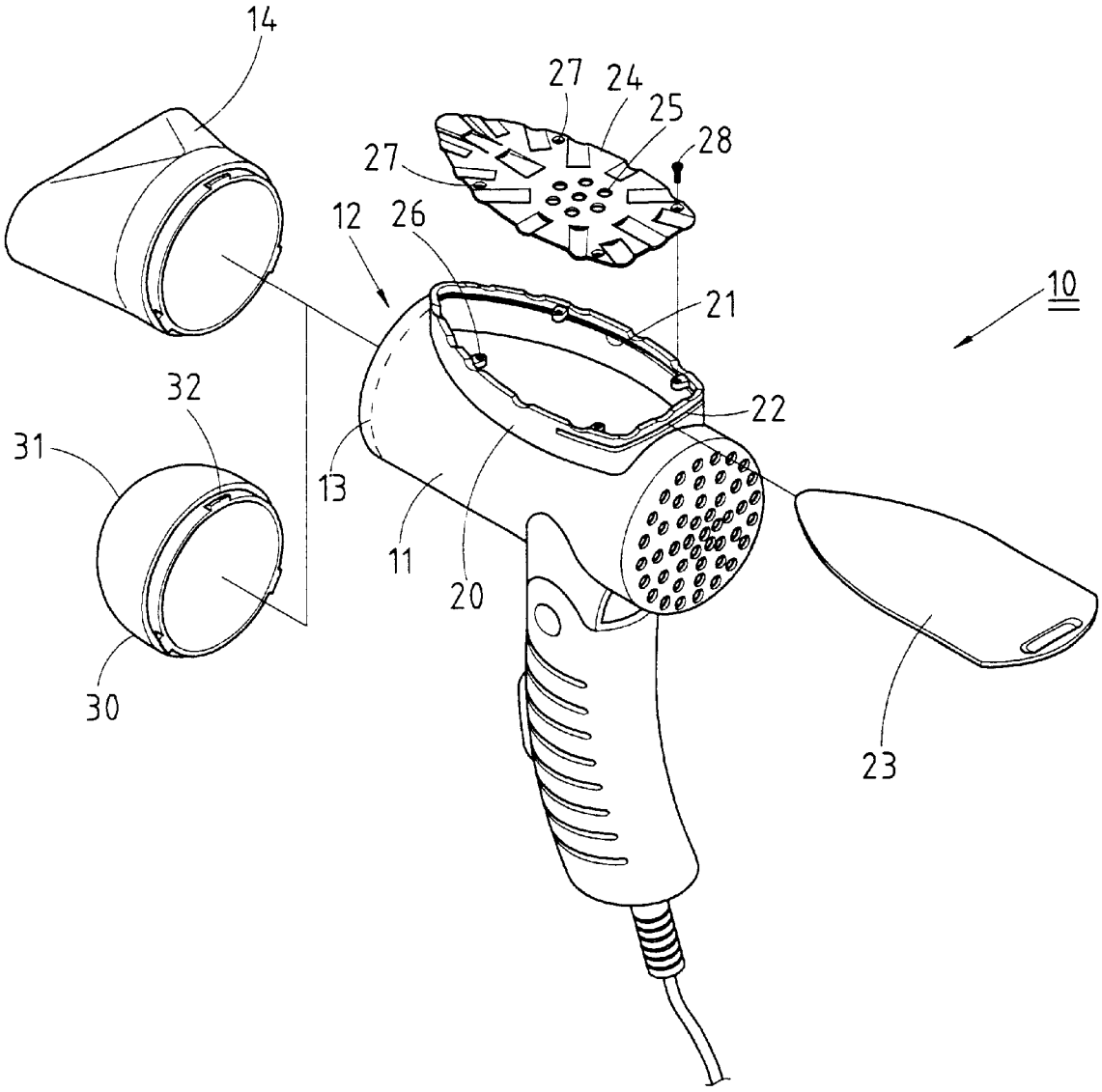
FIG. 2 shows an exploded perspective view of the preferred embodiment of the present invention.

As shown in all drawings provided herewith, a hair dryer 10 embodied in the present invention comprises a barrel 11 which is provided at the open end with a retaining groove 13 and in the top with a through slot 20 in communication with the hollow interior of the barrel 11. The through slot 20 is provided in the wall with a plurality of retaining slots 21 and an insertion slot 22 for receiving a hot air obstruction plate 23 which seals off the through slot 20. The wall of the through slot 20 is further provided with a plurality of fastening projections 26. A hot plate 24 is fastened to the through slot 20 by a plurality of screws 28 which are engaged with the fastening projections 26 via through holes 27 of the hot plate 24. The hot plate 24 is provided with a plurality of air holes 25.

The barrel 11 is provided at the open end with a barrel grille 14 which is detachably fastened thereto, and a barrel cap 30 which is also detachably fastened thereto. The barrel cap 30 has a closed end 31 and a plurality of retainers 32. It must be noted here that the hot air obstruction plate 23 is removably received in the insertion slot 22 of the wall of the through slot 20 of the barrel 11.

Figure 3:
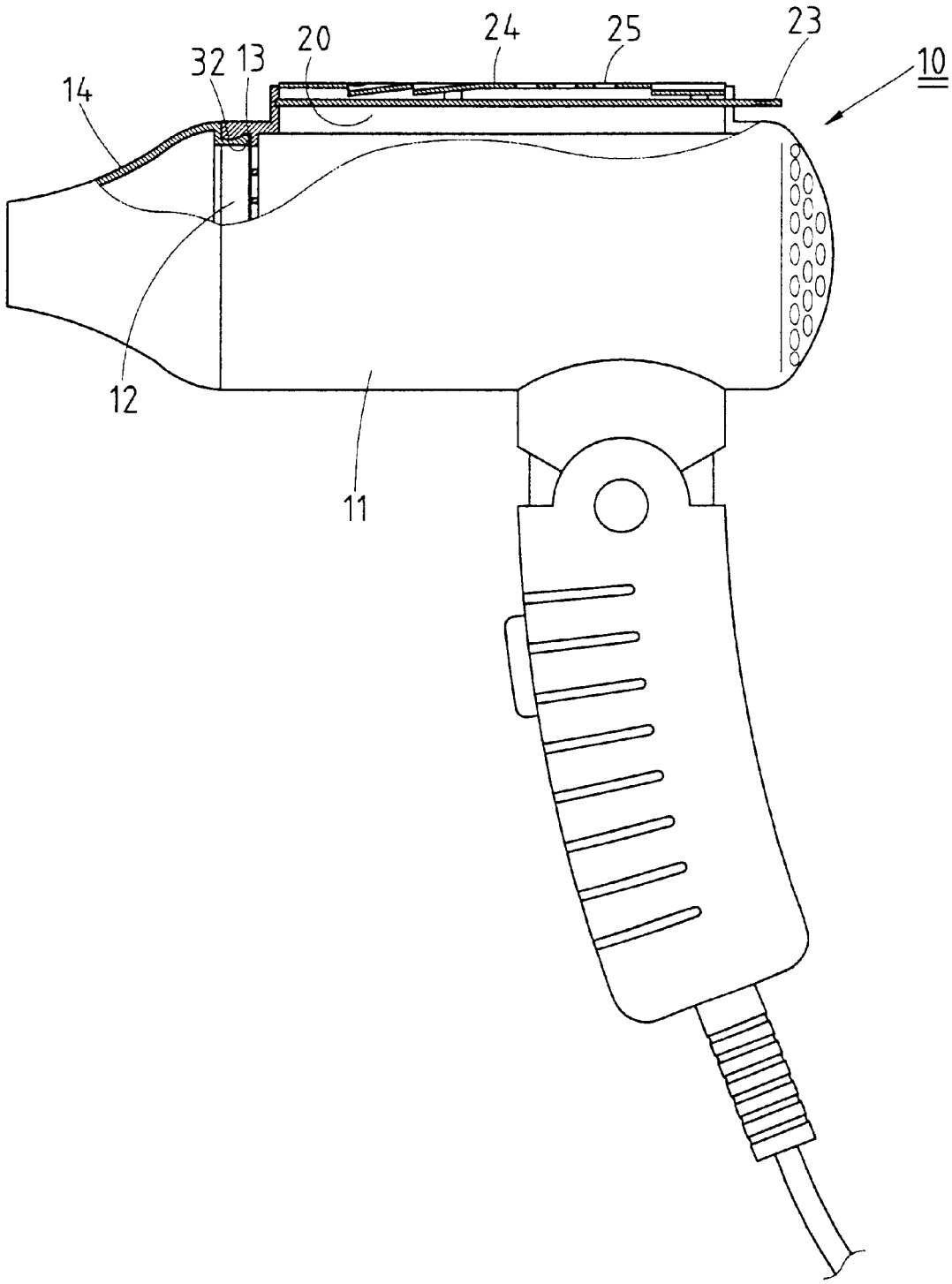
FIG. 3 shows a sectional schematic view of the preferred embodiment of the present invention in use as the hair dryer.
Figure 4:
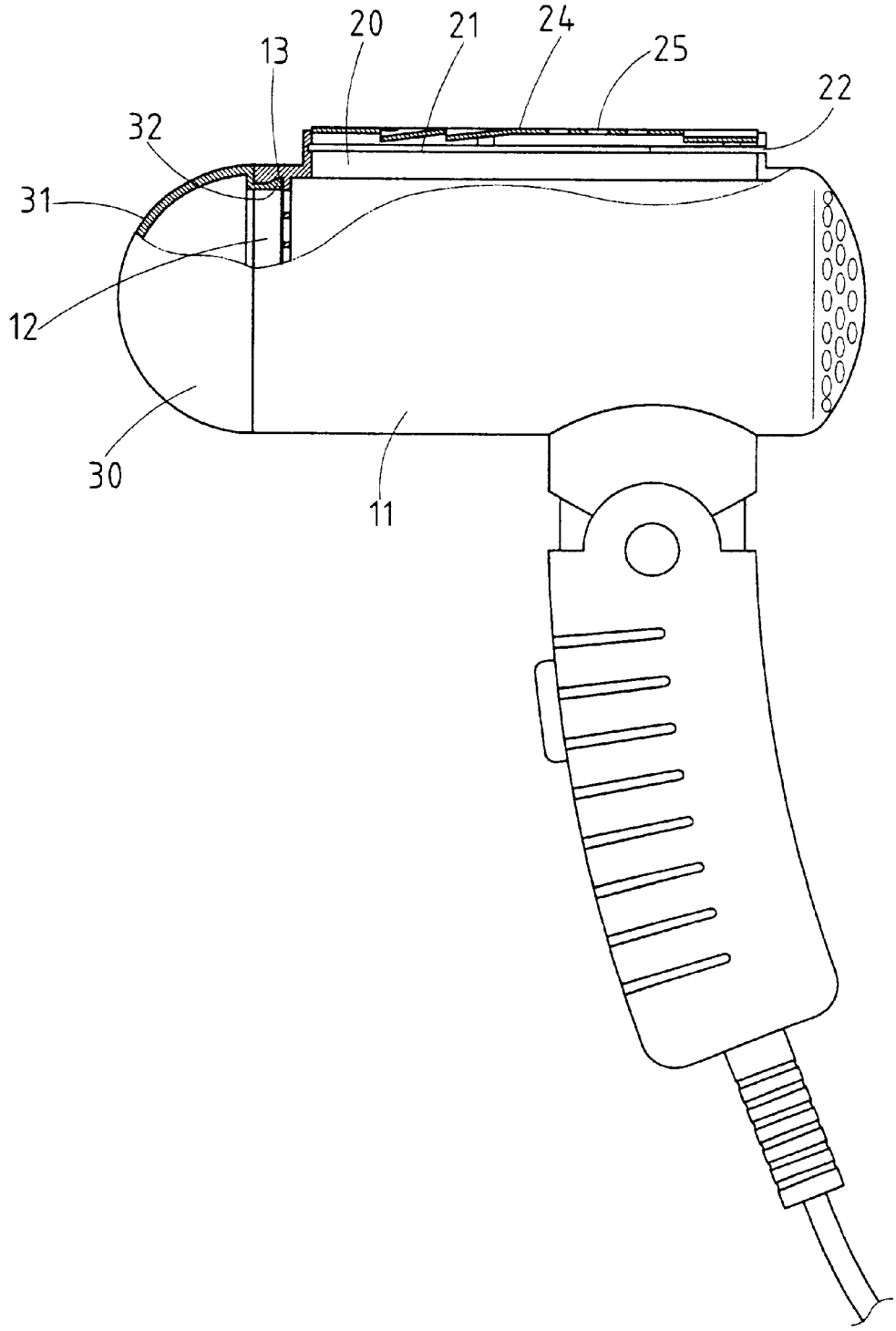
FIG. 4 shows a sectional schematic view of the preferred embodiment of the present invention in use as the flatiron.
Figure 5:
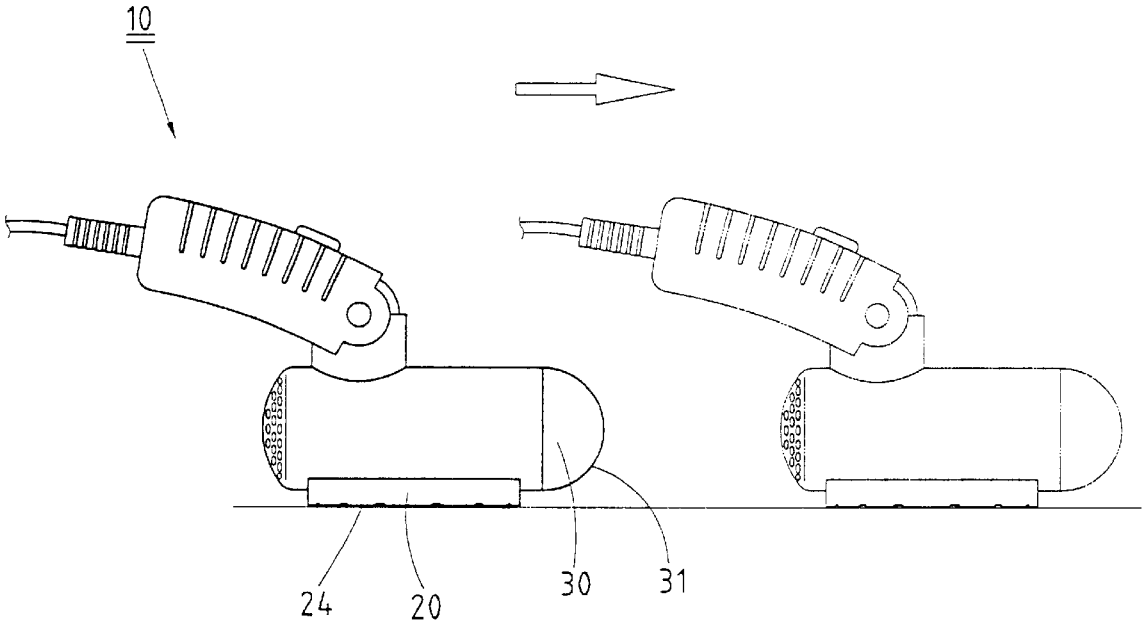
FIG. 5 shows a schematic view of the preferred embodiment of the present invention in action of pressing clothes.
Figure 6:
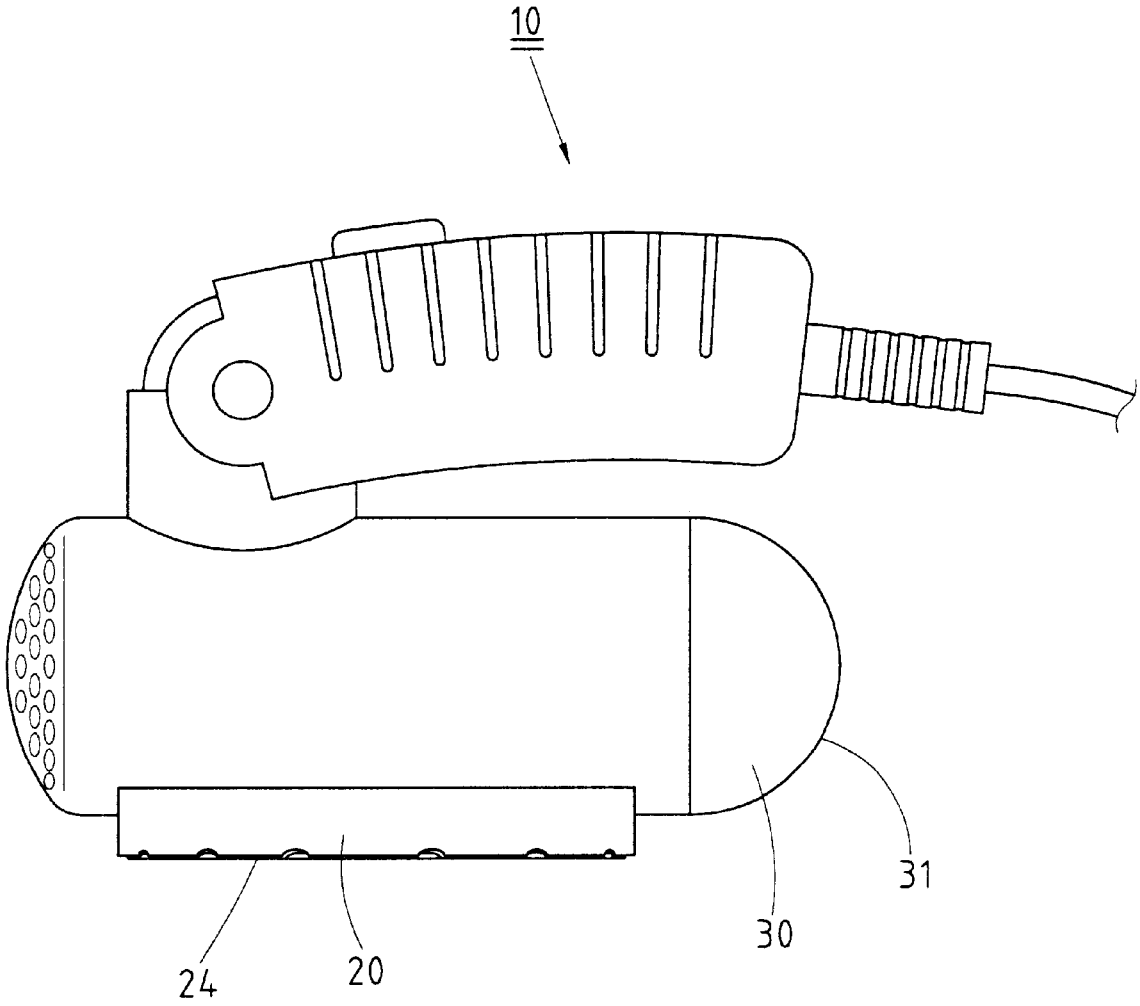
FIG. 6 shows a schematic view of the preferred embodiment of the present invention in the folded state.

Without using the barrel cap 30, the hair dryer 10 is used for grooming hair, as show in FIG. 3. On the other hand, the hair dryer 10 of the present invention is used as an iron by replacing the barrel grille 14 with the barrel cap 30 and by removing the hot air obstruction plate 23 from the insertion slot 22 of the through slot 20, as shown in FIGS. 4 and 5. Without the hot air obstruction plate 23, the hot air of the hair dryer 10 is let out via the air holes 25 of the hot plate 24 to facilitate the pressing of clothes. In the meantime, the barrel cap 30 prevents the escape of the hot air from the open end of the barrel 11. The hot plate 24 serves as a soleplate of the pressing iron, as illustrated in FIG. 5.

I claim:

1. A dual purpose implement serving interchangeably as a hair dryer and a flatiron, comprising:

a barrel being comprised of a hollow interior and an open end in communication with said hollow interior, said barrel being provided in a top surface with a through slot in communication with said hollow interior, said through slot comprised of a wall and an insertion slot located in said wall;

a barrel grille detachably fastened to said open end of said barrel;

a hot plate fastened to said through slot of said barrel and comprised of a plurality of air holes in communication with said hollow interior of said barrel and atmospheric air;

a hot air obstruction plate removably received in said insertion slot of said wall of said through slot of said barrel whereby said hot air obstruction plate serves to prevent the escape of hot air in said hollow interior of said barrel via said air holes of said hot plate; and a barrel cap detachably fastened to said open end of said barrel to prevent the escape of hot air in said hollow interior of said barrel via said open end of said barrel;

said implement serving as the hair dryer by fastening said barrel grille to said open end of said barrel;

said implement serving as the flatiron in such a way that said barrel grille is first unfastened from said open end of said barrel, and that said barrel cap is then fastened to said open end of said barrel, and further that said hot air obstruction plate is removed from said insertion slot of said wall of said through slot of said barrel.

* * * * *